United States Patent [19]

Parslow et al.

[11] Patent Number: 4,648,979

[45] Date of Patent: Mar. 10, 1987

[54] DETERGENT COMPOSITION

[75] Inventors: Michael W. Parslow, Upton by Chester, Great Britain; Jacobus R. Nooi, Hellevoetsluis, Netherlands

[73] Assignee: Lever Brothers Company, New York, N.Y.

[21] Appl. No.: 769,654

[22] Filed: Aug. 27, 1985

[30] Foreign Application Priority Data

Aug. 29, 1984 [GB] United Kingdom ..... 8421801

[51] Int. Cl.[4] ..... C11D 3/30; C11D 3/386

[52] U.S. Cl. ..... 252/8.8; 252/174.12; 252/525; 252/528; 252/544; 252/547; 252/DIG. 12

[58] Field of Search ..... 252/8.8, 174.12, 547, 252/544, DIG. 12, 525, 528

[56] References Cited

U.S. PATENT DOCUMENTS

| | | | |
|---|---|---|---|
| 4,292,035 | 9/1981 | Battrell | 8/137 |
| 4,338,204 | 7/1982 | Spadini et al. | 252/8.75 |
| 4,479,881 | 10/1984 | Tai | 252/8.8 |

FOREIGN PATENT DOCUMENTS

| | | |
|---|---|---|
| 6294 | 1/1984 | Japan . |
| 1368599 | 10/1974 | United Kingdom . |
| 2075028 | 11/1981 | United Kingdom . |

*Primary Examiner*—Prince E. Willis

*Attorney, Agent, or Firm*—Milton L. Honig; James J. Farrell

[57] ABSTRACT

The invention pertains to detergent compositions for simultaneously cleaning and softening fabrics comprising detergent-active materials, a primary or secondary amine and cellulase. The compositions combine good cleaning performance with effective textile softening performance on a wide range of textile materials.

7 Claims, No Drawings

DETERGENT COMPOSITION

This invention relates to detergent compositions for washing fabrics, in particular to detergent compositions which are capable of cleaning and softening fabrics from the same wash liquor.

Detergent compositions for simultaneously cleaning and softening fabrics are known in the art. Conventionally such compositions contain, as a detergent active material, an anionic surfactant to clean the fabrics and a cationic fabric softening agent. However, there is a tendency for the anionic and cationic components of such compositions to react with each other, either in the product itself or in the wash liquor, with the result that the efficiency of the cationic softening agent and of the anionic detergent active material is reduced.

It has been proposed to provide a fabric-softening effect in laundry detergent compositions by the use of alternative fabric-softening materials which are noncationic in nature. One such example is to use certain long-chain water-insoluble tertiary amines that are nonionic in character at the wash-liquor pH existing when a conventional laundry detergent is used, as disclosed in British Pat. No. 1,514,216 and European Patent Application Nos. 0011340 and 0026528.

This type of softening agents, if used on its own, requires a high level of incorporation for effective softening performance.

Another example is to use cellulolytic enzymes i.e. cellulase, as a harshness reducing agent, as disclosed in British Patent Specification GB No. 1,368,599, GB-A-2,075,028, GB-A-2,095,275 and GB-A-2,094,826.

A disadvantage of cellulase is that it only exerts a softening effect on cellulosic fibres. Furthermore if used on its own, cellulase requires a relatively high level for effective single wash softening performance.

It has now been found that an improved detergent composition can be formulated which very well combines cleaning performance together with effective textile softening performance on a wide range of textile materials, by using a mixture of a long chained primary or secondary amine and cellulase as the essential fabric softening ingredients.

Thus, according to the invention, there is provided a detergent composition for cleaning and softening fabrics comprising:

(a) a detergent active material;

(b) a long chained primary or secondary amine; and (c) cellulase

(a) The detergent active material

The compositions according to the invention necessarily contain a detergent active material, otherwise referred to herein simply as a detergent compound. The detergent compounds may be selected from anionic, nonionic, zwitterionic and amphoteric synthetic detergent active materials. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates, sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcoholalkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Suitable nonionic detergent compounds which may be used include in particular the reaction products of compounds having as hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, generally 5 to 25 EO, i.e. 5 to 25 units of ethylene oxide per molecule, the condensation products of aliphatic ($C_8$–$C_{18}$) primary or secondary linear or branched alcohols with ethylene oxide, generally 5 to 40 EO, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds.

The effective amount of the detergent active compound or compounds used in the composition of the present invention is generally in the range of from 2 to 50%, preferably from 5 to 40% by weight, most preferably not more than 30% by weight of the composition.

(b) The long chained primary or secondary amine

The primary and secondary amines suitable for the purpose of the invention are water-insoluble compounds having the general formula:

$R_1R_2NH$ wherein $R_1$ is a $C_{12}$–$C_{26}$ alkyl or alkenyl group and $R_2$ is H or a $C_1$–$C_7$ alkyl, or a $C_{12}$–$C_{26}$ alkyl or alkenyl group.

Preferred amines are primary amines of the above formula wherein $R_1$ is a $C_{12}$–$C_{22}$ alkyl or alkenyl group and $R_2$=H, which can be used as such or as their salts.

Examples of suitable amines include:

primary tallow amine
primary palmityl amine
primary stearyl amine
primary oleyl amine
primary coconut amine
primary behenyl amine
secondary di-lauryl amine
secondary distearyl amine
secondary tallow methyl amine
primary tallow amine hydrochloride
primary tallow amine acetate.

Mixtures of any of these amines may be used.

Especially preferred are primary $C_{12}$–$C_{22}$ alkyl/alkenyl amines containing more than 50% of $C_{16}$–$C_{22}$ alkyl-/alkenyl amines, which are commercially available as Armeen 16D, Armeen HT, Armeen HTD, Armeen 18, Armeen 18D, Armeen T and Armeen TD from Armour Chemical Industries Ltd. and as Noram ®S, Noram SH and Noram 42 from the CECA Company.

These long chained primary and/or secondary amines may be used in the composition of the invention in an amount ranging from 0.5 to 15% by weight, preferably from 1% to 10% by weight and most preferably from 2 to 5% by weight.

(c) The cellulase

The cellulase usable in the present invention may be any bacterial or fungal cellulase having a pH optimum of between 5 and 11.5. It is however preferred to use cellulases which have optimum activity at alkaline pH values, such as those described in UK patent Application GB No. 2,075,028 A; UK Patent Appln. GB No. 2,095,275 A and German Pat. Appln. No. 2 247 832.

Examples of such alkaline cellulases are cellulases produced by a strain of *Humicola insolens* (*Humicola grisea* var. *thermoidea*), particularly the Humicola strain DSM 1800, and cellulases produced by a fungus of Bacillus N or a cellulase 212-producing fungus belonging to the genus Aeromonas, and cellulase extracted from the hepatopancreas of a marine mullosc (Dolabella Auricula Solander).

The cellulase added to the composition of the invention may be in the form of a non-dusting granulate, e.g. "marumes" or "prills", or in the form of a liquid in which the cellulase is provided as a cellulase concentrate suspended in e.g. a nonionic surfactant or dissolved in an aqueous medium, having cellulase activity of at least 250 regular $C_x$ cellulase activity units/gram, measured under the standard conditions as described in GB No. 2,075,028 A.

The amount of cellulase in the composition of the invention will, in general, be from about 0.1–10% by weight in whatever form. In terms of cellulase activity the use of cellulase in an amount corresponding to from 0.25 to 150 or higher regular $C_x$ units/gram of the detergent composition is within the scope of the present invention. A preferred range of cellulase activity, however, is from 0.5 to 25 regular $C_x$ units/gram of the detergent composition.

Optional Ingredients

The detergent compositions of the present invention may of course include, as optional ingredients, components that are usually found in laundry detergents.

These include detergency builder salts, bleaching agents and organic precursors therefor, suds depression agents, soil-suspending and anti-redeposition agents, enzymes, e.g. proteolytic and amylolytic enzymes, optical brighteners, colouring agents and perfumes.

Detergency builder salts are a preferred component (d) of the compositions of the invention and can be inorganic or organic in character. Non-limiting examples of suitable water-soluble, inorganic alkaline detergent builder salts include the alkali metal carbonates, borates, phosphates, polyphosphates, bicarbonates, and silicates. Specific examples of such salts include the sodium and potassium tetraborates, bicarbonates, carbonates, triphosphates, pyrophosphates, penta-polyphosphates and hexametaphosphates. Sulphates are usually also present.

Examples of suitable organic alkaline detergency builder salts are:

(1) water-soluble amino polyacetates, e.g. sodium and potassium ethylenediaminetetraacetates, nitrilotriacetates, N-(2-hydroxyethyl) nitrilodiacetates and diethylene triamine pentaacetates;
(2) water-soluble salts of phytic acid, e.g. sodium and potassium phytates;
(3) water-soluble polyphosphonates, including sodium, potassium and lithium salts of methylenediphosphonic acid and the like and aminopolymethylene phosphonates such as ethylenediaminetetramethylenephosphonate and diethylene triaminepentamethylene phosphate, and polyphosphonates described in British Patent Application No. 38724/77.
(4) water-soluble polycarboxylates such as the salts of lactic acid, succinic acid, malonic acid, maleic acid, citric acid, carboxymethylsuccinic acid, 2-oxa-1,1,3-propane tricarboxylic acid, 1,1,2,2-ethane tetracarboxylic acid, mellitic acid and pyromellitic acid.

Mixtures of organic and/or inorganic builders can be used herein. One such mixture of builders is disclosed in Canadian Patent Specn. No. 755 038, e.g. a ternary mixture of sodium tripolyphosphate, trisodium nitrilotriacetate, and trisodium ethane-1-hydroxy-1,1-diphosphonate.

Another type of detergency builder material useful in the present compositions and processes comprise a water-soluble material capable of forming a water-insoluble reaction product with water hardness cations preferably in combination with a crystallization seed which is capable of providing growth sites for said reaction product. Such "seeded builder" compositions are fully disclosed in British Patent Specification No. 1,424,406.

Preferred water-soluble builders are sodium tripolyphosphate and sodium silicate, and usually both are present. In particular, it is preferred that a substantial proportion, for instance from 3 to 15% by weight of the composition of sodium silicate (solids) of ratio (weight ratio $SiO_2$:$Na_2O$) from 1:1 to 3.5:1 be employed.

A further class of detergency builder materials useful in the present invention are insoluble sodium aluminosilicates, particularly those described in Belgian Patent Specn. No. 814,874, issued Nov. 12, 1974. This patent specification discloses and claims detergent compositions containing sodium aluminosilicate of the formula:

$$Na_z(AlO_2)_z(SiO_2)_y xH_2O$$

wherein z and y are integers equal to at least 6, the molar ratio of z to y is in the range of from 1.0:1 to about 0.5:1 and x is an integer from about 15 to about 264. A preferred material is $Na_{12}(SiO_2AlO_2)_{12}27H_2O$. About 5% to 25% by weight of aluminosilicate may be used as a partial replacement for water-soluble builder salts, provided that sufficient water-soluble alkaline salts remain to provide the specified pH of the composition in aqueous solution.

The detergent builder salts are normally included in amounts of from 10% to 80% by weight of the composition, preferably from 20% to 70% and most usually from 30% to 60% by weight.

Bleaching agents useful in the compositions of the invention include sodium perborate, sodium percarbonate and other perhydrates at levels of from 5% to 35% by weight of the composition. Organic peroxy bleach precursors such as tetra acetyl ethylene diamine and tetra acetyl glycouril can also be included and these and other precursors are disclosed in German Patent Application No. 2,744,642.

In compositions incorporating oxygen bleaches, bleach stabilisers are also preferred components, usually at levels of from 0.2% to 2% by weight of the composition. The stabilisers may be organic in nature such as the previously mentioned amino polyacetates and amino polyphosphonates or may be inorganic such as magnesium silicate. In the latter case the material may be added to the formulation or formed in situ by the addition of a water-soluble magnesium salt to a slurried detergent mix containing an alkali metal silicate.

Suds controlling agents are often present. These include suds boosting or suds stabilising agents such as mono- or di-ethanolamides of fatty acids. More often in modern detergent compositions, suds depressing agents are required. Soaps, especially those having 18 carbon atoms, or the corresponding fatty acids, can act as effective suds depressors if included in the anionic surfactant component of the present compositions. Usually about 1% to about 4% of such soap is effective as a suds suppressor. Very suitable soaps, when suds suppresion is a primary reason for their use, are those derived from Hyfac (Trade Name for hardened marine oil fatty acids predominantly $C_{18}$ to $C_{22}$ acids available from the Humko Corporation).

However, non-soap suds suppressors are preferred in synthetic detergent-based compositions of the invention, since soap or fatty acid tends to give rise to a characteristic odour in these compositions.

Preferred suds suppressors comprise silicones. In particular there may be employed a particulate suds suppressor comprising silicone and silanated silica releasably enclosed in water-soluble or -dispersible substantially non-surface-active detergent impermeable carrier. Suds-depressing agents of this sort are disclosed in British Patent Specn. No. 1 407 997. A very suitable granular (prilled) suds-depressing product comprises 7% silica/silicone (15% by weight silanated silica, 85% silicone, obtained from Messrs. Dow Corning), 65% sodium tripolyphosphate, 25% tallow alcohol condensed with 25 molar proportions of ethylene oxide, and 3% moisture. The amount of silica/silicone suds-suppressor employed depends upon the degree of suds suppression desired, but it is often in the range of from 0.01% to 0.5% by weight of the detergent composition. Other suds-suppressors which may be used are water-insoluble, preferably microcrystalline, waxes having a melting point in the range of from 35° to 125° C. and a saponication value of less than 100, as described in British Patent Specn. No. 1,492,938.

Yet other suitable suds suppressing systems are mixtures of hydrocarbon oil, a hydrocarbon wax and hydrophobic silica as described in European Patent Application No. 78 2000 035 and, especially, particulate suds-suppressing compositions comprising such mixtures, combined with an ethoxylated nonionic surfactant having an HLB in the range of from 14 to 19 and a compatibilising agent capable of forming inclusion compounds, such as urea. These particulate suds-suppresing compositions are described in European Patent Appln. No. 0 00 8830.

Soil-suspending agents are usually present at about 0.1 to 10%, such as water-soluble salts of carboxymethylcellulose, carboxyhydroxymethyl cellulose, polyethylene glycols of molecular weight of from about 400 to 10,000 and copolymers of methylvinylether and maleic anhydride or acid, available under the Trade Name Gantrez.

Proteolytic, amylolytic or lipolytic enzymes, especially proteolytic, and optical brighteners, of anionic, cationic or nonionic types, especially the derivatives of sulphonated triazinyl diamino stilbene may be present.

Photoactivated bleaches such as the tri and tetra sulphonated derivatives of zinc phthalocyanine are also useful components of the present composition.

Colours, non-substantive, and perfumes, as required to improve the aesthetic acceptability of the product, are usually incorporated. Throughout the description herein where sodium salts have been referred to, potassium, lithium or ammonium or amine salts may be used instead if their extra cost etc., are justified for special reasons.

PREPARATION OF THE COMPOSITIONS

The detergent compositions may be prepared in any way appropriate to their physical form, such as by dry-mixing the components, co-agglomerating them or dispersing them in a liquid carrier. However, a preferred physical form is a granule incorporating a detergency builder salt and this is most conveniently manufactured by spray-drying at least part of the composition. For the purpose of the following discussion, components of the composition that are normally added to a detergent crutcher mix and spray-dried are identified as (a), components which are applied in the liquid form by spray-on to other solid components are identified as (b) and components which are added as solids other than in the spray-dried portion are identified as (c).

Conventionally, the compositions are prepared by making up an aqueous slurry of the non-heat-sensitive components (a), comprising the anionic and/or nonionic surfactants, builder and filler salts together with any soil-suspending agents and optical brighteners, and spray-drying this slurry. The moisture content of the slurry is normally in the range of 28% to 36% and its temperature is conveniently in the range of 70°–95° C. The spray-drying tower inlet temperatures are normally in the range of 300°–360° C. and the resultant spray-dried granules have a moisture content of 8–12% by weight. An optional, but preferred, additional processing step is to cool the dried granules rapidly by means of cool air from a temperature of 90° C. to a temperature in the range of 25°–35° C., in order to facilitate the further processing of the product. Solid heat-sensitive components (c), such as persalts and enzymes, are mixed with the spray-dried granules. Although the water-insoluble amine component may be included in the slurry for spray-drying, it may degrade under certain processing conditions and adversely affect product quality. It is therefore preferred that the water-insoluble primary or secondary amine be liquefied by melting or solvent dissolution and that this liquid (b) be sprayed either onto the spray-dried granules before or after the other heat-sensitive solids have been dry-mixed with them or onto a suitable carrier and dry-mixed with the spray-dried granules. If the amine is applied as a melt, a liquid temperature of 5°–30° C. in excess of the melting point can conveniently be used for the spray-on. Since the amine is generally a waxy solid of rather low melting point, it may be blended with a compatible higher melting substance so as to ensure that granules sprayed on therewith are sufficiently crisp, are free-flowing and do not cake on storage.

The invention is illustrated by way of the following non-limiting examples.

EXAMPLE

The following detergent compositions were prepared:

| (% by weight) | A | B | C | D | E | F | G |
|---|---|---|---|---|---|---|---|
| Sodium linear $C_{12}$ alkyl benzene sulphonate | 5.5 | 5.5 | 5.5 | 5.5 | 5.5 | 5.5 | 5.5 |
| $C_{13}$—$C_{15}$ fatty alcohol/11 ethylene oxide condensate | 3.0 | 3.0 | 3.0 | 3.0 | 3.0 | 3.0 | 3.0 |
| Sodium soap | 2.0 | 2.0 | 2.0 | 2.0 | 2.0 | 2.0 | 2.0 |
| Sodium tri-phosphate | 30.0 | 30.0 | 30.0 | 30.0 | 30.0 | 30.0 | 30.0 |
| Sodium silicate (1:2) | 5.5 | 5.5 | 5.5 | 5.5 | 5.5 | 5.5 | 5.5 |
| Optical brightener | 0.2 | 0.2 | 0.2 | 0.2 | 0.2 | 0.2 | 0.2 |
| Sodium sulphate | 21.7 | 18.5 | 20.1 | 22.8 | 21.8 | 18.8 | 17.8 |
| Sodium perborate tetrahydrate | 21.0 | 21.0 | 21.0 | 21.0 | 21.0 | 21.0 | 21.0 |
| Proteolytic enzyme | 0.3 | 0.3 | 0.3 | 0.3 | 0.3 | 0.3 | 0.3 |
| Ditallowyl methylamine | — | 4.0 | — | — | — | — | — |
| Primary tallow amine | — | — | 2.0 | — | — | 4.0 | 4.0 |
| Cellulase (445 reg. $C_x$ units/g) | 0.8 | — | 0.4 | — | — | — | — |
| Cellulase (365 reg. $C_x$ units/g) | — | — | — | — | 1.0 | — | 1.0 |
| Moisture and miscellaneous | | | | balance | | | |

The compositions (A–C) were used to wash different types of test swatches (10×10 cm) in a Tergotometer washing experiment using 10 g/l of product and a cloth:liquor ratio of 1:10 with 30° FH water. Each washing was carried out at 40° C. for 20 minutes.

The softening effects were rated by a team of panelists, scoring 1 as the best, 2 as second best, etc.

In the results below the better results are thus indicated by lower scores:

| | Softening effects score on | | |
|---|---|---|---|
| | A | B | C |
| (1) New cotton | | | |
| after 1 wash | 47 | 39 | 24 |
| after 3 washes | 55 | 29 | 31 |
| (2) Preharshened cotton | | | |
| after 1 wash | 35 | 43 | 41 |
| after 3 washes | 45 | 37 | 38 |
| (3) Acrylic | | | |
| after 1 wash | 53 | 36 | 33 |
| after 3 washes | 62 | 27 | 27 |

The results show that composition C of the invention containing 2.0% primary tallow amine and 0.4% cellulase, is clearly superior to composition A containing 0.8% cellulase alone and is equally effective as composition B containing 4.0% tertiary amine alone, on both cotton and acrylic fabrics.

Preharshened cotton is representative of used cotton fabrics which have been washed several times without sufficiently being softened.

Compositions (D–G) were used to wash preharshened terry monitors. The product dosage was 5 g/l, the water hardness was 8° GH and the pH of the wash liquor was approximately 9.3. A MIELE (Trade Mark) automatic washing machine was used on 25° C. to 40° C. and 25° C. to 80° C. heat up cycles, heating up at 2° C./min. The wash time was 35 minutes. After washing the monitors were rinsed 3 times in tap water. After 5 washes the monitors were line-dried and then assessed for softness using a laboratory fabric softness measuring device. The results were as set out in the following Table, the softness of the monitors washed once in the control formulation being taken as 100%.

| Example No | % softness after 5 washes | |
|---|---|---|
| | 40° C. | 80° C. |
| D (control) | 100 | 100 |
| E | 109 | 103 |
| F | 104 | 98 |
| G | 114 | 108 |

A comparison of the results obtained from all compositions relative to the control shows that both cellulase and, to a lesser extent, amine improve the measured softening. A comparison of the results obtained from compositions G and E, F shows that the use of amine and cellulase together gives a softening benefit which is greater than the use of either softening component alone.

We claim:

1. A detergent composition for cleaning and softening fabrics comprising:

(a) from 2 to 50% by weight of a detergent-active material selected from the group of anionic, non-ionic, zwitterionic and amphoteric synthetic detergent-active materials;

(b) from 0.5 to 15% by weight of an amine selected from the group of primary amines having a $C_{12}$–$C_{26}$ alkyl or alkenyl group, and secondary amines having the general formula:

$R_1R_2NH$ wherein $R_1$ is a $C_{12}$–$C_{26}$ alkyl or alkenyl group and $R_2$ is a $C_1$–$C_7$ alkyl or alkenyl group and (c) from 0.1 to 10% by weight of a bacterial or fungal cellulase having a pH optimum of between 5 and 11.5.

2. A composition according to claim 1 wherein the cellulase has an optimum activity at alkaline pH values.

3. A composition according to claim 1 wherein the cellulase has an activity corresponding to at least 0.5 to 25 regular $C_x$ cellulase activity units per gram of the detergent composition.

4. A composition according to claim 1 wherein the amine is a primary amine having a $C_{12}$–$C_{22}$ alkyl or alkenyl group.

5. A composition according to claim 4 in which more than 50% of the amine has a $C_{16}$–$C_{22}$ alkyl or alkenyl group.

6. A composition according to claim 1 comprising 1–10% by weight of the amine.

7. A composition according to claim 1 comprising 5–40% of the detergent-active material.

* * * * *